US005127195A

United States Patent [19]

Heesemann

[11] Patent Number: 5,127,195

[45] Date of Patent: Jul. 7, 1992

[54] PROFILE GRINDING MACHINE AND METHOD

[75] Inventor: Juergen Heesemann, Bad Oeynhausen, Fed. Rep. of Germany

[73] Assignee: Karl Heesemann Maschinenfabrik GmbH & Co. KG, Bad Oeynhausen, Fed. Rep. of Germany

[21] Appl. No.: 546,307

[22] Filed: Jul. 3, 1990

[30] Foreign Application Priority Data

Jul. 3, 1989 [DE] Fed. Rep. of Germany ..... 3921800

[51] Int. Cl.[5] ..... B24B 21/00

[52] U.S. Cl. ..... 51/149; 51/150

[58] Field of Search ..... 51/111 R, 112, 80 R, 51/80 A, 80 B, 80 BS, 81 R, 81 BS, 84 R, 84 BS, 91 R, 166 TS, 166 TM, 149, 150, 137, 140, 141; 76/86; 407/89

[56] References Cited

U.S. PATENT DOCUMENTS 1,699,510 1/1929 Gaisman et al. ..... 51/111 R 4,220,428 9/1980 Suzuki ..... 407/89

*Primary Examiner*—M. Rachuba

*Attorney, Agent, or Firm*—Foley & Lardner

[57] ABSTRACT

A profile grinding machine has at least two tool holders which are fixed in a frame and on each of which is fixed a grinding tool, for machining workpieces transported past the profile grinding machine in a working plane. The tool holders can be arranged in various angular positions, and their tools complement each other to give the desired profile shape. The advantages of a uniform grinding operation can be achieved in spite of the use of a plurality of tools by arranging the tool holders at essentially the same height in the transporting direction and by the tools of two neighboring tool holders forming the desired profile shape by a complementarily toothed design of the mutually facing edges, one engaging in the other.

20 Claims, 6 Drawing Sheets

PROFILE GRINDING MACHINE AND METHOD

BACKGROUND OF THE INVENTION

The invention relates to a profile grinding machine having at least two tool holders, which are fixed in a frame, and on each of which is fixed a grinding tool for machining workpieces transported past the profile grinding machine in a working plane; the tool holders being arranged in various angular positions, and their tools complementing each other to give the desired profile shape.

For certain grinding tasks, it is expedient to machine the profile shape to be ground with a plurality of tools, for example two. The reason for this may lie in a problematical positioning of only a single tool. Furthermore, the use of a single tool in the case of a profile encompassed by the tool leads to the disadvantage that tolerances in the workpiece thickness lead to considerable impairments of the grinding result. Tools which, in contrast, grind only a part of the profile in each case are less likely to be troubled by changes in the workpiece thickness. It is therefore known to machine complicated profile shapes, or profile shapes which are to be ground on opposite sides, with a plurality of tools, each of which only accomplishes a partial grinding operation. These tools are frequently arranged directly one behind the other in the conveying direction in a holding device. In the case of belt grinding machines, the belt running in the transporting direction, consequently runs successively over the plurality of tools. This means that considerable space is required in the conveying direction. Furthermore, in special grinding tasks, the possibility of problems at the end of the grinding area of the last tool cannot be ruled out.

SUMMARY OF THE INVENTION

The invention is therefore based on the object of designing a profile grinding machine of the type mentioned above in such a way that a satisfactory grinding result is achieved with the use of a plurality of grinding tools requiring little space.

In accordance with a first aspect of the invention, a profile grinding machine is provided for forming a desired profile shape of workpieces as the workpieces are transported in a transporting direction through the profile grinding machine in a conveying plane. The profile grinding machine includes a holding device, a pair of tool holders attached to a frame at angles with respect to one another and being arranged at essentially the same height, and a grinding tool mounted in each of the tool holders. The grinding tools have edges which face each other in a complimentary toothed design in which a tooth of one edge engages a gap formed between two adjacent teeth of the other edge, and which are adapted to form the desired profile.

In accordance with another aspect of the invention, one of a holding device connecting the two holders to the frame and the tool holders has a plurality of holes formed therein. The plurality of holes can be aligned with at least two holes formed in the other of the holding device and the tool holders for fixing the tool holders in place, whereby the angular positions of the tool holders with respect to one another is adjustable.

In accordance with another aspect of the invention, a pair of connecting pieces connects the grinding tools to the respective tool holders. Each of the connecting pieces is pivotable with respect to a longitudinal axis of the respective tool holder. In addition, each of the connecting pieces can be translationally displaced perpendicularly with respect to the longitudinal axis.

In accordance with yet another aspect of the invention, a rotating tool turret may be attached to the holding device. The tool turret has a plurality of tool holder sets mounted thereon with the pair of tool holders being included in one of the tool holder sets. The tool holders in each tool holder set are arranged in various angular positions with respect to one another, so that tools of each set compliment each other to give the desired profile shape.

Another object of the invention is to provide a method or forming a desired profile shape of workpieces in a profile grinding machine.

In accordance with one aspect of the invention, the method includes the steps of attaching a pair of tool holders to a frame at angles with respect to one another at essentially the same height, mounting a grinding tool in each of the tool holders, the grinding tools having edges which face each other in a complimentary toothed design in which a tooth of one edge engages a gap formed between two adjacent teeth of the other edge, transporting the workpieces in a conveying plane in which the workpieces are in contact with the edges of the grinding tools. This transportation through the machine in contact with the complimentary surfaces forms the desired profile shape.

In accordance with another aspect of the invention, a step of fixing each of the tool holders to a holding device connecting the tool holders to the frame includes the step of aligning a plurality of holes formed in one of the holding device and the tool holder with a pair of holes formed in the other of the holding device and the tool holder. A further step includes fixing the tool holder to the holding device through the aligned holes, thereby adjusting the angular positions of the tool holders with respect to one another.

In accordance with another aspect of the invention, the step of mounting each of the grinding tools on the respective tool holder includes the step of mounting the grinding tool in a connecting piece, and mounting the connecting piece on the tool holder. Other steps include rotating the connecting piece with respect to a longitudinal axis of the tool holder, and translationally displacing the connecting piece perpendicularly with respect to the longitudinal axis.

Other objects, features and advantages of the present invention will become apparent to those skilled in the art from the following detailed description. It should be understood, however, that the detailed description and specific examples, while indicating preferred embodiments of the present invention, are given by way of illustration and not limitation. Many changes and modifications within the scope of the present invention may be made without departing from the spirit thereof, and the invention includes all such modifications.

BRIEF DESCRIPTION OF THE DRAWINGS

Further advantages of the invention and further advantageous embodiments are explained in further detail below with reference to illustrative embodiments represented in the drawings, in which.

DETAILED DESCRIPTION OF THE PREFERRED EMBODIMENTS

The objects of the invention are achieved, in the case of a profile grinding machine having two tool holders fixed on a frame and having grinding tools held by the tool holders, with the tool holders being arranged at essentially the same height in the transporting direction and by the tools of two neighboring tool holders forming the desired profile shape by a complementarily toothed design of the mutually facing edges, one tooth engaging in the other. That is, a tooth of the first edge engages a gap formed between two adjacent teeth of the second edge in the manner best seen in FIG. 1.

The profile grinding machine according to the invention consequently has an arrangement of the tools which makes it possible for the grinding operation to be carried out in one step, but does not have the disadvantages of the rigid form of a one-part tool. The arrangement in which the tools are disposed at an angle to each other can compensate for any thickness tolerance of the workpiece by a certain compliance in the axial direction of their tool holders. In the case of a belt grinding machine, the belt, running in the transporting direction, runs simultaneously over the plurality of tools. In the area in which the two tools overlay, the two tools alternately determine the grinding shape in an identical way.

Figure 1:
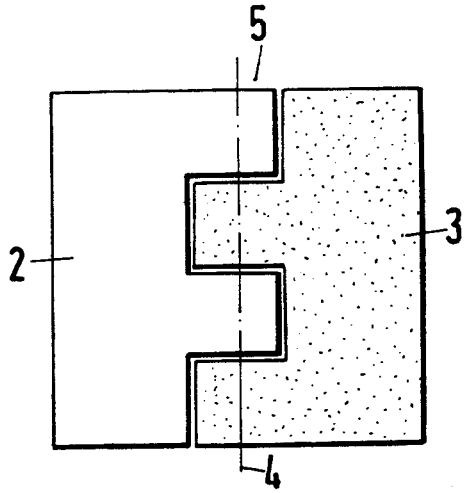
FIG. 1 shows a view of two toothed tools, seen from the transporting plane of the workpiece, arranged in accordance with the present invention.
Figure 2:
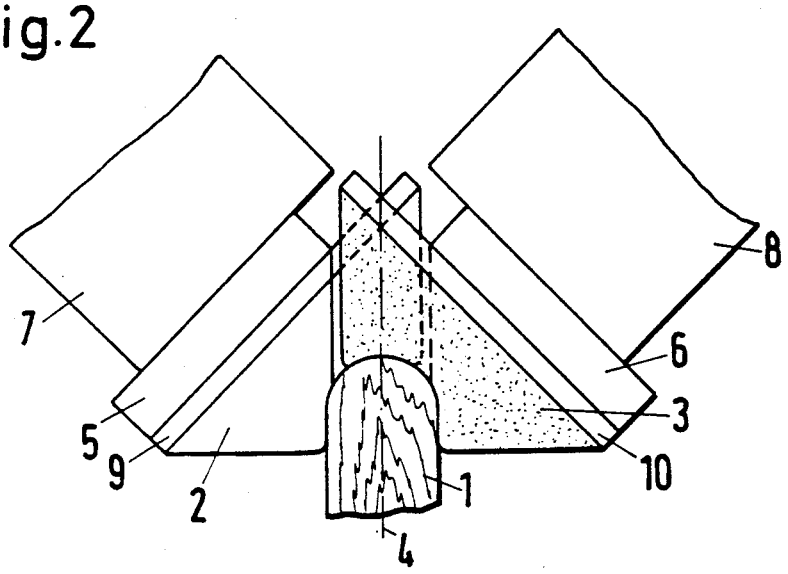
FIG. 2 shows a side view of the two tools with an end piece of a workpiece moved in the transporting plane.

FIG. 1 shows a plan view of the effective sides of two tools 2, 3, which face a workpiece 1 and—as FIG. 2 illustrates—are disposed at an angle to each other as well as overlap each other in an overlapping area 5, lying symmetrically to the transporting direction and the conveying plane 4, in such a way that a workpiece 1 moved in the conveying plane 4 bears alternately against the one tool 2 and the other tool 3, in the overlapping area 5.

As illustrated in FIG. 2, tools 2, 3 are fixed to respective tool holders 7 and 8 via connecting pieces 5 and 6. The edges of the tools 2, 3 are designed to be parallel and perpendicular to the conveying plane and direction 4, so that the baseplates 9, 10 carrying the tools 2, 3 also have to be of a toothed design in order to be able to engage one through the other in the way necessary for this design of the tools 2, 3.

The tool holders 7, 8 are both at an angle of 45° with respect to the conveying plane 4, and consequently form an angle of 90° with respect to each other. To create the necessary space for the baseplates 9 and 10, the connecting pieces 5, 6 are arranged offset out of the center axis of the workpiece holders toward the workpiece, and consequently clear the space for the inner ends of the baseplates 9, 10.

Figure 3:
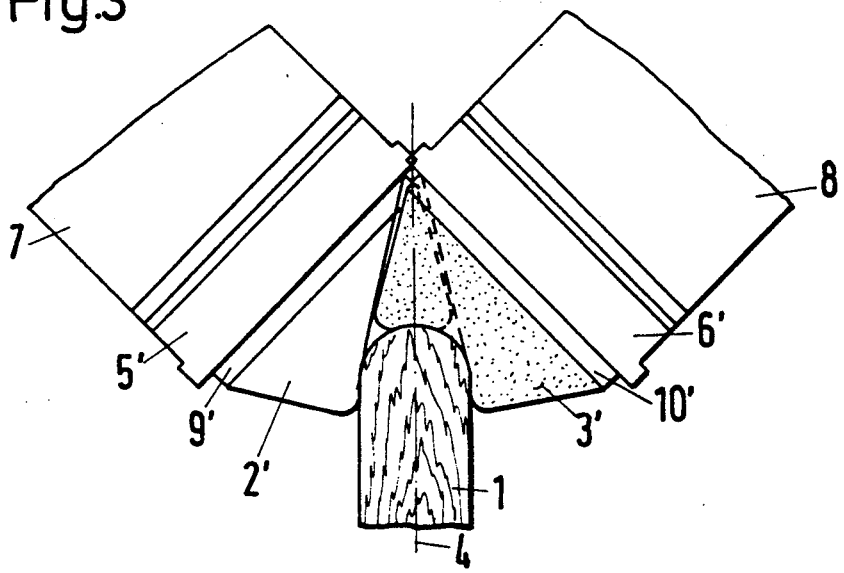
FIG. 3 shows a view according to FIG. 2 with modified tools.

In the case of the illustrative embodiment represented in FIG. 3, the side edges of the tools 2', 3'are designed to be bevelled with respect to the conveying plane 4 in such a way that the size of the baseplates 9', 10' can be kept so small that they virtually do not overlap at their inner ends. Consequently, the connecting pieces 5', 6, can be designed symmetrically to the longitudinal axis of the tool holders 7, 8.

FIGS. 1 to 3 reveal that the complete grinding operation for the rounded-off edge of the workpiece 1 is carried out at the same place in the conveying plane or direction, but with two tools 2, 3 or 2', 3', which are at an angle of, for example, 90° with respect to each other, and consequently can compensate for thickness tolerances of the workpiece 1 on account of a slight mobility of the tool in the direction of the center axis of the tool holders 7, 8.

For an edge of the workpiece 1 which is ground in the profile shape of a semicircle, the arrangement of the two tools 2, 3 or 2', 3' at an angle of 45° with respect to the conveying plane 4 is expedient. For other profile shapes at the edges of workpieces 1, a different angular position may be more advantageous.

For carrying out various grinding tasks and for adapting to the desired profile shapes, it is therefore expedient if the tool holders can be fixed in various angular positions in the frame. This may preferably be realized by the tool holders being fixed on a holding device having a contact surface arranged perpendicularly to the conveying plane and direction and being releasably fixed on the holding device in various angular positions. The releasable fixing is very easy to arrange if the holding device and/or the tool holders have a plurality of holes which align with at least two holes of the tool holder or of the holding device for fixing the respective tool holder in various angular positions.

In any case, it is advantageous if the tool is fixed on the tool holder by a connecting piece which can be swivelled in the direction of the angular position, the connecting piece in addition being able to be translationally displaced perpendicularly to the longitudinal axis of the tool holder as well. The connecting piece allows fine adjustments of the tools with respect to each other to be carried out.

Figure 4:
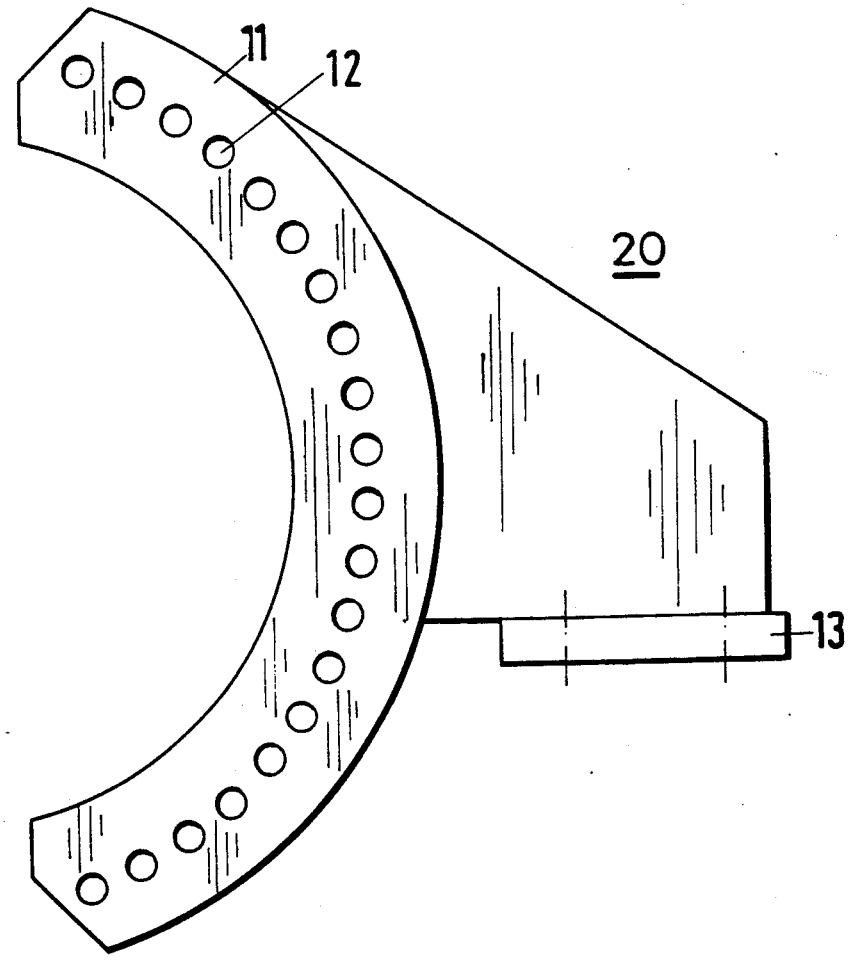
FIG. 4 shows a first embodiment of a holding device for the tool holders.

FIG. 4 therefore shows a holding device 20 on which tool holders 7, 8 can be fixed in various angular positions. The holding device 20 has a sickle-like front attachment 11, which is provided with a semi-circular arc-like arrangement of a multiplicity of holes 12. The holding device 20 is fixed by a fixing flange 13 on a crossmember (not shown) of a frame of the profile grinding machine.

Figure 5:
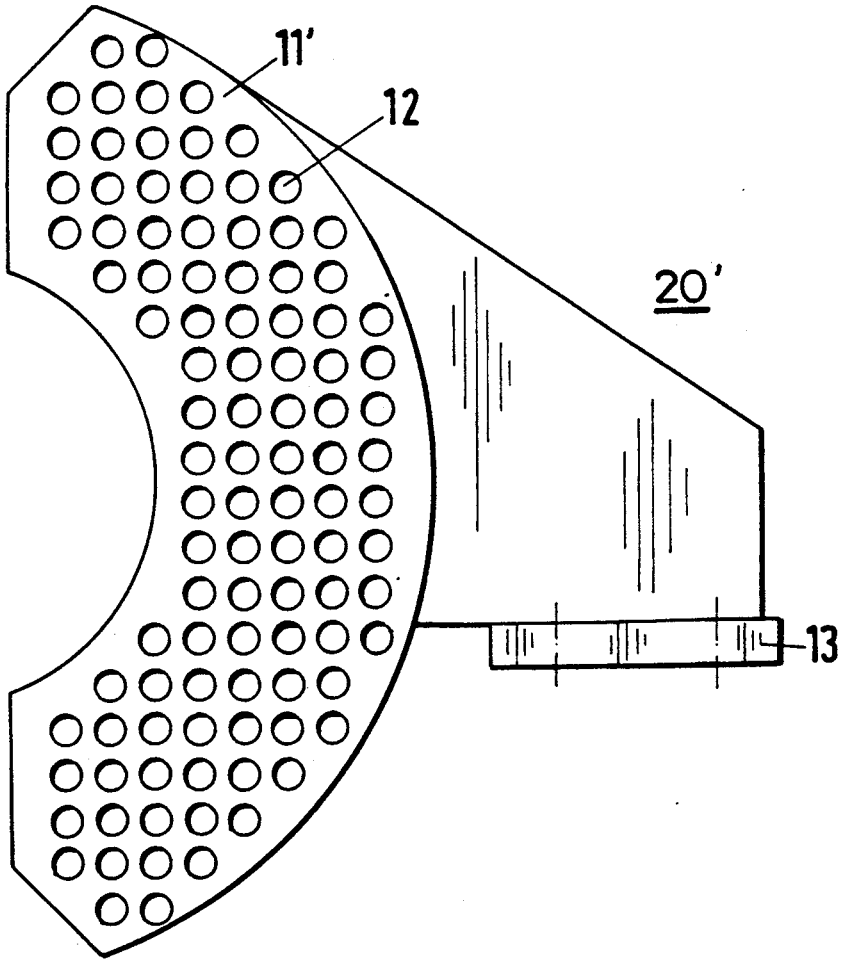
FIG. 5 shows a further embodiment of a holding device for tool holders.

In the illustrative embodiment according to FIG. 5, a holding device 20' is represented, of which the sickle-like attachment 11' is of a substantially broader design and has a multiplicity of rows of holes 12 arranged in areas, which form a sickle-like grid. This holding device 20' therefore allows a greater range of variation in the fitting of the tool holders 7, 8.

Figure 6:
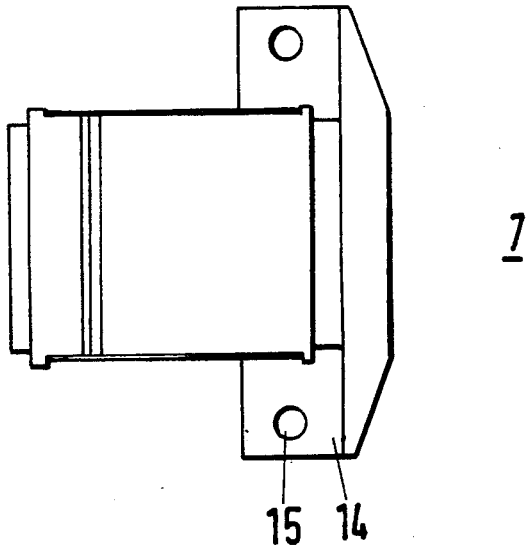
FIG. 6 shows an illustrative embodiment for a tool holder.

FIG. 6 shows a tool holder 7 which can be screwed onto the holding devices 20, 20'. The tool holder 7 has two lateral attachments 14, each of which bear a hole 15. The spacing between the holes 15 matches the spacing of the holes 12 of the holding devices 20, 20', as will be further illustrated with reference to FIG. 9.

Figure 7:
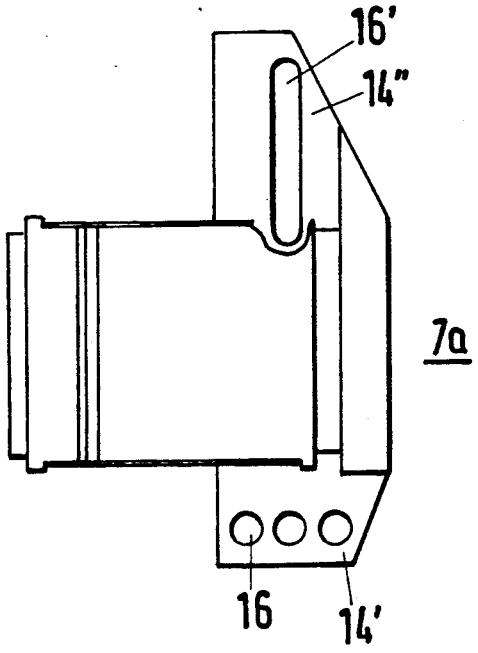
FIG. 7 shows a second illustrative embodiment for a tool holder.

In the case of the provision of the tool holder *7a* represented in FIG. 7, the lateral attachments 14', 14'' are designed in such a way that the one attachment 14' bears three round holes 16, aligned parallel to the longitudinal axis of the tool holder *7a*, while the other lateral attachment 14'' is equipped with an elongated slot 16', which extends perpendicularly to the longitudinal axis of the tool holder *7a*. Due to the slot 16', this tool holder *7a* can be fixed without any problems in the hole grid of the sickle-shaped attachment 11' of the holding device 20' in various angular positions.

Figure 8:
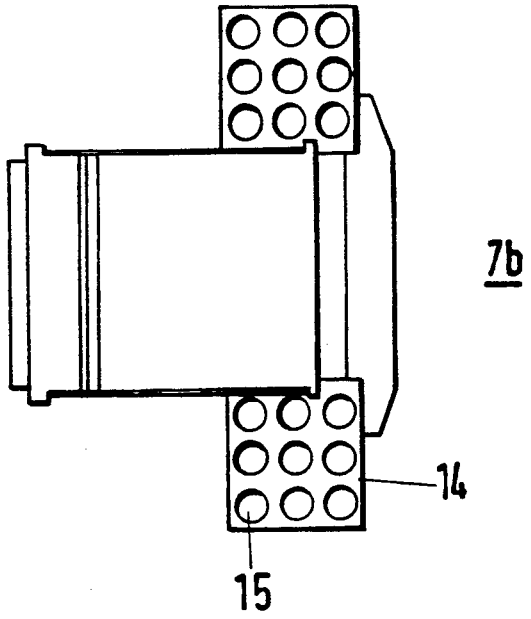
FIG. 8 shows a third illustrative embodiment for a tool holder.

Many possible variations of the fixings can be achieved with the tool holder *7b* which is represented in FIG. 8. There are numerous holes 15, arranged in a grid-like form, on its lateral attachments 14.

Figure 9:
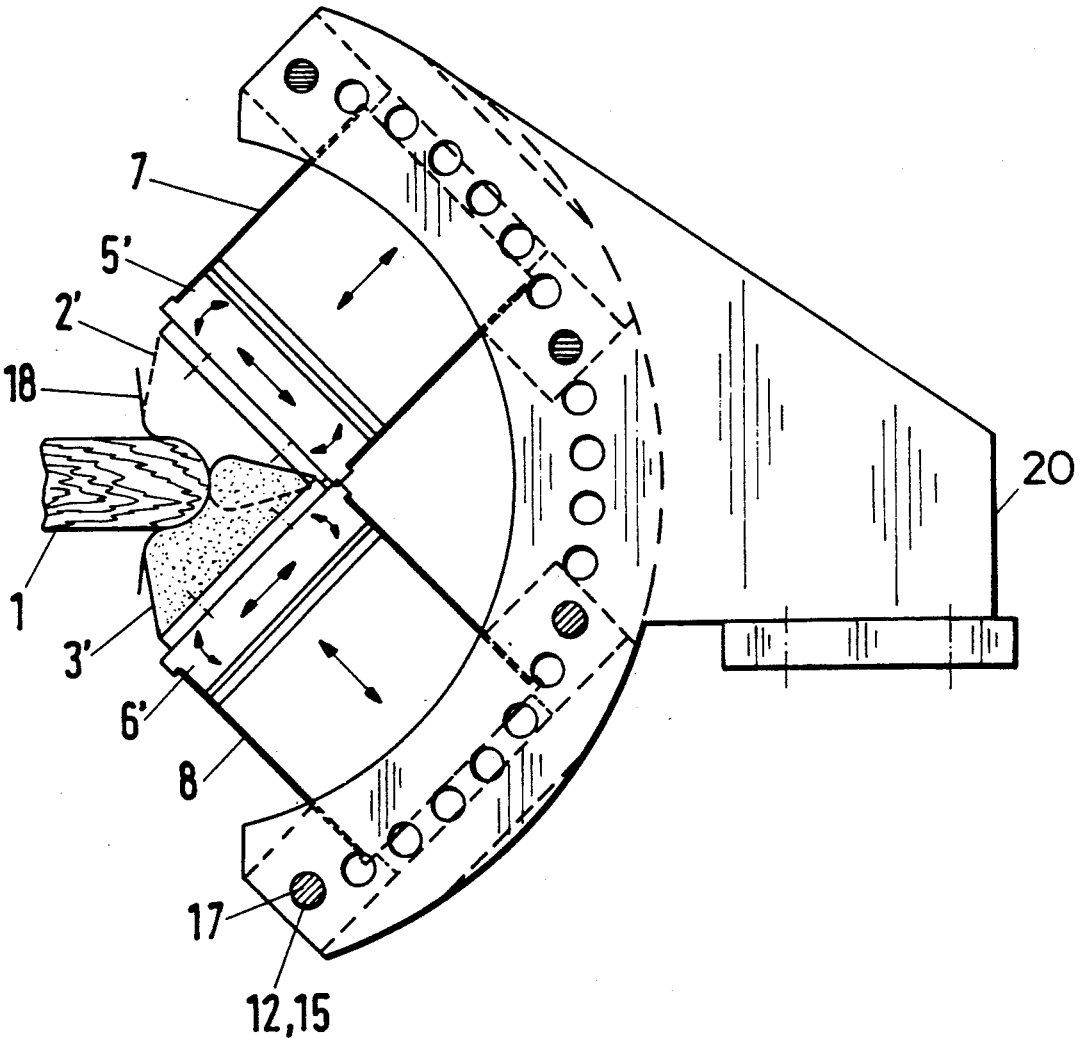
FIG. 9 shows an illustrative embodiment for the variable fixing of the tool holders on a holding device according to FIG. 4.

An example of the fixing of tool holders 7, 8, shown in FIG. 6, on a holding device 20, such as is shown in FIG. 4, is illustrated by FIG. 9. The fixing is performed by screws 17 protruding through the mutually aligned holes 12, 15, which screws may also be replaced by rivets or the like.

As illustrated by arrows in FIG. 9, the connecting pieces 5', 6' can preferably be mounted on holders 7 and 8 so as to be displaced laterally with respect to the associated tool holder 7, 8, that is to say perpendicularly to its longitudinal axis, and are also designed such that they can tilt or rotate with respect to its longitudinal axis. As a result of these displacements, a fine adjustment of the tools 2', 3' can be achieved, so that an optimum adaptation to the edge to be ground of the workpiece 1 can be accomplished.

FIG. 9 also illustrates that a grinding belt 18, extended in the transporting direction, is taken, i.e., runs over the tools 2', 3', so that the tools 2', 3' are responsible for the grinding contact pressure in the desired shaping, while the actual abrasive is on the grinding belt 18. The grinding belt 18 essentially bears against the tools 2', 3' simultaneously at points where the complimentary toothed edges of the tools 2', 3' intermesh with one another, so that to this extent the advantages of a uniform grinding operation, as is the case with a single tool, come about.

The design of the profile grinding machine according to the invention can also be accomplished with a rotating tool turret which has a plurality of tool holder sets, the tool holders in each tool holder set being capable of being arranged in various angular positions with respect to one another, so that their tools complement each other to give the desired profile shape. This makes it possible, by rotation of the tool turret, to bring into action toothed tools for various profile shapes without requiring major converting measures. The rotation of the tool turret in this case can be performed both about an axis of rotation lying in the transporting direction, i.e., the conveying plane 4, of the workpieces, and about an axis of rotation arranged perpendicularly thereto.

Although the illustrative embodiments described only show two tools 2, 3 and 2', 3', it is quite evident from what has been described that an arrangement of three or more tools is also possible, the adjacent edges of the tools being of a toothed design and overlapping.

What is claimed is:

1. A profile grinding machine for forming a desired profile shape of workpieces by grinding only the edges of the workpieces as the workpieces are transported in a transporting direction through the profile grinding machine in a conveying plane, said profile grinding machine comprising:

(A) a frame;

(B) a pair of tool holders attached to said frame at angles with respect to one another and being arranged at essentially the same height;

(C) a grinding tool mounted in each of said tool holders, said grinding tools having edges which face each other in a complementary toothed design in which a tooth of one edge engages a gap formed between adjacent teeth on the other edge, said teeth having opposed side walls with shapes which complement the shape of said desired profile, said side walls being adapted to apply a grinding pressure to said edges of said workpieces to form said desired profile, said grinding tools including a belt which is interposed between said side walls and said workpieces, which is supported on said complimentary toothed edges of said grinding tools at points where said complimentary toothed edges intermesh, and which abrades said edges of said workpieces under the pressure of said side walls at said points.

2. The profile grinding machine of claim 1, wherein the angular positions of said tool holders with respect to said frame are adjustable.

3. The profile grinding machine of claim 1, further comprising a holding device connecting said tool holders to said frame, wherein said holding device has a contact surface extending perpendicularly to said conveying plane and said transporting direction.

4. The profile grinding machine of claim 3, wherein one of said holding device and said tool holders has a plurality of holes formed therein, and wherein said plurality of holes can be aligned with at least two holes formed in the other of said holding device and said tool holders for fixing the tool holders in place, whereby the angular positions of said tool holders with respect to one another is adjustable.

5. The profile grinding machine of claim 4, wherein the holes of said plurality of said holes are formed in said holding device and are aligned in a semi-circular arc on said holding device.

6. The profile grinding machine of claim 4, wherein at least one of said at least two holes comprises an elongated slot.

7. The profile grinding machine of claim 4, wherein both said tool holders and said holding device have a plurality of holes formed therein arranged in the form of hole grids.

8. The profile grinding machine of claim 1, wherein said grinding tools are non-rotatably mounted on said tool holders.

9. A profile grinding machine for forming a desired profile shape of workpieces by grinding only the edges of the workpieces as the workpieces are transported in a transporting direction through the profile grinding machine in a conveying plane, said profile grinding machine comprising:

(A) a frame;

(B) a pair of tool holders attached to said frame at angles with respect to one another and being arranged at essentially the same height;

(C) a grinding tool mounted in each of said tool holders, said grinding tools having edges which face each other in a complementary toothed design in which a tooth of one edge engages a gap formed between adjacent teeth on the other edge, said teeth having opposed side walls with shapes which complement the shape of said desired profile, said side walls being adapted to apply a grinding pressure to said edges of said workpiece to form said desired profile; and (D) a pair of connecting pieces connecting said grinding tools to the respective tool holders, each of said connecting pieces being pivotable with respect to a longitudinal axis of the respective tool holder.

10. The profile grinding machine of claim 9, wherein each of said connecting pieces can be translationally displaced perpendicularly with respect to said longitudinal axis.

11. A method of forming a desired profile shape of workpieces in a profile grinding machine having an effective surface with a shape which complements the desired profile shape, said method comprising the steps of:

(A) attaching a pair of tool holders to a frame at angles with respect to one another at essentially the same height;

(B) mounting a grinding tool in each of said tool holders, said grinding tools have edges which face each other in a complementary toothed design in which a tooth of one edge engages a gap formed between adjacent teeth of the other edge, said teeth having opposing side walls with shapes which complement the shape of said desired profile; and (C) transporting said workpieces in a conveying plane in which only the edges of the workpieces are ground by an abrasive belt, with grinding pressures imposed on said workpieces by said side walls of said grinding tools, thereby forming said desired profile shape;

wherein said step of transporting said workpiece comprises the step of transporting said workpiece through said tool in contact with said abrasive belt, said abrasive belt being interposed between said side walls and said workpiece, being supported by said complimentary toothed edges of said tool at points where said complimentary toothed edges intermesh, and abrading said edges of said workpiece under the pressure of said side walls at said point.

12. The method of claim 11, further comprising the step of adjusting the angular positions of said tool holders with respect to said frame.

13. The method of claim 11, wherein the step of attaching each of said tool holders to said frame comprises the steps of aligning a plurality of holes formed in one of a holding device, connecting said frame to said tool holders, and said tool holder with a pair of holes formed in the other of said holding device and said tool holder, and fixing said tool holder to said holding device through the aligned holes, thereby adjusting the angular positions of said tool holders with respect to one another.

14. The method of claim 11, further comprising the step of holding said grinding tools while said workpiece is transported through said cutting plane.

15. A method of forming a desired profile shape of workpieces in a profile grinding machine having an effective surface with a shape which complements the desired profile shape, said method comprising the steps of:

(A) attaching a pair of tool holders to a frame at angles with respect to one another at essentially the same height;

(B) mounting a grinding tool in each of said tool holders, said grinding tools have edges which face each other in a complementary toothed design in which a tooth of one edge engages a gap formed between adjacent teeth of the other edge, said teeth having opposing side walls with shapes which complement the shape of said desired profile; and (C) transporting said workpieces in a conveying plane in which only the edges of the workpieces are ground by pressures imposed on said workpieces by said side walls of said grinding tools, thereby forming said desired profile shape;

wherein the step of mounting each of said grinding tools on the respective tool holder comprises the steps of mounting said grinding tool in a connecting piece, mounting said connecting piece on said tool holder, and pivoting said connecting piece with respect to a longitudinal axis of said tool holder.

16. The method of claim 15, further comprising the step of translationally displacing said connecting piece perpendicularly with respect to said longitudinal axis.

17. A profile grinding machine for forming a desired profile shape of workpieces by grinding only the edges of the workpieces as the workpieces are transported in a transporting direction through the profile grinding machine in a conveying plane, said profile grinding machine comprising:

(A) a pair of tool holders fixed at angles with respect to one another and being arranged at essentially the same height;

(B) means for supporting said tool holders on said profile grinding machine; and (C) a grinding tool means, mounted in each of said tool holders, for forming said desired profile, said grinding tool means having edges which face each other in a complementary toothed design in which a tooth of one edge engages a gap formed between adjacent teeth of the other edge, said teeth having opposing side walls with shapes which complement the shape of said desired profile, said teeth being adapted to engage said edges of said workpieces to form said desired profile, said grinding tool means including a belt which is interposed between said side walls and said workpieces, which is supported on said complimentary toothed edges of said grinding tool means at points where said complimentary toothed edges intermesh, and which abrades said edges of said workpieces under the pressure of said side walls at said points.

18. The profile grinding machine of claim 17, wherein said tool holders comprises a holding device having a contact surface extending perpendicularly to said conveying plane and transporting direction.

19. The profile grinding machine of claim 18, wherein one of said holding device and said tool holders has a plurality of holes formed therein, and wherein said plurality of holes can be aligned with at least two holes formed in the other of said holding device and said tool holders for fixing the tool holders in place, whereby the angular positions of said tool holders with respect to said holding device is adjustable.

20. A profile grinding machine for forming a desired profile shape of workpieces by grinding only the edges of the workpieces as the workpieces are transported in a transporting direction through the profile grinding machine in a conveying plane, said profile grinding machine comprising:

(A) a pair of tool holders fixed at angles with respect to one another and being arranged at essentially the same height;

(B) means for supporting said tool holders on said profile grinding machine;

(C) a grinding tool means, mounted in each of said tool holders, for forming said desired profile, said grinding tool means having edges which face each other in a complementary toothed design in which a tooth of one edge engages a gap formed between adjacent teeth of the other edge, said teeth having opposing side walls with shapes which complement the shape of said desired profile, said teeth being adapted to engage said edges of said workpieces to form said desired profile; and (D) means for connecting said grinding tool means to said tool holders, wherein said means for connecting comprises connecting pieces located between said grinding tool means and said tool holders, each of said connecting pieces being pivotable with respect to a longitudinal axis of the respective tool holder, and also being displaceable perpendicularly with respect to said longitudinal axis.

* * * * *